United States Patent [19]

Jarosz et al.

[11] 4,434,415

[45] Feb. 28, 1984

[54] ELECTRICAL CONTROL MODULE FOR A CURRENT-LIMITING FUSE

[75] Inventors: John M. Jarosz, Skokie; William R. Panas, Glenview, both of Ill.

[73] Assignee: S&C Electric Company, Chicago, Ill.

[21] Appl. No.: 439,443

[22] Filed: Nov. 5, 1982

[51] Int. Cl.[3] ..... H01H 85/20

[52] U.S. Cl. ..... 337/186; 337/201; 337/413

[58] Field of Search ..... 337/186, 187, 201, 205, 337/227, 235, 248, 413, 414

[56] References Cited

U.S. PATENT DOCUMENTS

| | | | |
|---|---|---|---|
| 3,628,092 | 12/1971 | Keto | 337/186 X |
| 3,835,432 | 9/1974 | Caione | 337/186 X |
| 4,153,893 | 5/1979 | Swanson | 337/201 |

*Primary Examiner*—George Harris

*Attorney, Agent, or Firm*—John D. Kaufmann

[57] ABSTRACT

A reusable control module mountable to a power-cartridge-operated interrupting module which includes a normally closed switch in shunt with a fuse. The control module houses a control circuit which ignites the power cartridge to open the switch. The control module includes two conductive shells threaded together to enclose the circuit, thereby providing a Faraday cage for the circuit and shielding the circuit from the environment. A current transformer is mounted in an exterior pocket in one of the shells over a mounting terminal thereon which extends out of the pocket to act as a single-turn primary for the transformer. The output of the transformer is connected to an input of the circuit. Circuit boards of the circuit are mounted within the shells, in part by a plastic plug, one end of which passes through one of the shells coaxially with a mounting neck. The other end of the plug has slots which engage and hold one edge of the boards. The plug contains a conductor connected to the output of the circuit. When the modules are mounted together via the neck, the conductor at the one end of the plug is electrically connected to the power cartridge and the shells can now carry the current in a protected circuit to the switch and the fuse. The plug is located on the axis of rotation of the shells when the shells are threaded together so that its holding and signal-carrying functions are not compromised.

17 Claims, 9 Drawing Figures

ELECTRICAL CONTROL MODULE FOR A CURRENT-LIMITING FUSE

BACKGROUND OF THE INVENTION

1. Field of the Invention

The present invention relates to an electrical control module for a current-limiting fuse and, more specifically, to a module containing electrical components which constitute a detecting and triggering circuit for a high-voltage current-limiting fuse. The module of the present invention is usable in the high-voltage current-limiting fuses described and clamined in commonly assigned U.S. Pat. No. 4,342,978, issued Aug. 3, 1982 in the name of Meister, and in the following commonly-assigned U.S. patent applications: Ser. No. 194,712, filed Oct. 6, 1980, now U.S. Pat. No. 4,359,708 in the names of Jarosz and Panas, Ser. No. 188,660, filed Sept. 19, 1980, now U.S. Pat. No. 4,370,531 in the name of Tobin; Ser. No. 179,367, filed Aug. 18, 1980, and Ser. No. 181,603, filed Aug. 27, 1980, both in the names of Jarosz and Panas; Ser. No. 179,336 filed Aug. 18, 1980 in the name of O'Leary; and Ser. No. 437,925 filed Nov. 1, 1982, and Ser. No. 437,926 filed Nov. 1, 1982, both in the names of Jarosz and Panas.

2. Brief Discussion of the Prior Art

The above-noted commonly assigned patent and patent applications relate to a high-voltage current-limiting fuse which comprises an interrupting module and an control module. The interrupting module comprises a switch section and a fuse section. The switch section has a pair of contacts which are movable relatively apart along a fixed line of direction. In preferred embodiments, one contact is stationary, while the other is movable. The contacts are normally electrically interconnected, resulting in the switch section being closed. A fusible element of the fuse section is in electrical shunt with the contacts of the switch section. When the switch section is closed, a majority of current in a high-voltage circuit to which the fuse is connected for protection thereof flows through the switch section and not through the fusible element. When the switch section is opened, the contacts separate, commutating current formerly flowing therethrough to the fusible element for interruption thereof. Opening of the switch section is achieved by the ignition of a power cartridge located in a cavity defined, in part, by the stationary contact and, in part, by a trailer or piston carried by the movable contact. When the power cartridge ignites, the pressure in the chamber rapidly increases, acting against the trailer to move it and the movable contact away from the stationary contact, to open the switch section.

As generally described in the above patent and patent applications, the ignition of the power cartridge occurs in response to a fault current or other overcurrent in the protected high-voltage circuit to which the fuse is connected. As generally described in the above patent and patent applications, the sensing of fault currents or other over-currents in the protected circuit is achieved by a detecting and triggering circuit which ignites the power cartridge when a fault current occurs.

Since the interrupting module includes a "one-shot" power cartridge, as well as a consumable fusible element, both of which must be replaced following operation of the fuse, a determination has been made that the switch section and the fusible element of the fuse section, which together constitute the interrupting module, should be maintained in a single housing and comprise the single, replaceable interrupting module. Further, since the detecting and triggering circuit is reusable, and normally is not adversely effected by the occurrence of a fault current or other overcurrent in the protected circuit nor by the operation of the interrupting module, it has been determined that the sensing and triggering circuit should be in its own separate, reusable electrical control module.

Accordingly, the present invention relates to the separate electrical control module which contains the detecting and triggering circuit usable with the above-described current-limiting fuse, which module embodies convenient, low cost assembly and may be conveniently associated with the interrupting module so that the two modules may be conveniently connected to a protected circuit for protection against fault currents or over-currents.

SUMMARY OF THE INVENTION

With the above and other objects in view, the present invention contemplates an electrical control module of a high-voltage current-limiting fuse which also includes an interrupting module. In general, the current-limiting fuse is of the type which is connectable in a high-voltage circuit for protection thereof. Current in the interrupting module is commutated from a switch to a fusible element, which is in electrical shunt therewith, upon opening of the switch. Opening of the switch occurs in response to the ignition of a power cartridge or similar pressure-generating device. One side of both the switch and the fusible element are commonly connectable to one side of the protected circuit. Includable with the control module are a current transformer and a detecting and triggering circuit. An output of the former is connectable to an input of the latter. The detecting and triggering circuit responds to a fault currents or other over-currents sensed by the current transformer to generate a power-cartridge-ignition signal at an output thereof.

The control module comprises a first conductive shell which defines first and second opposed cavities. The second cavity is capable of partially surrounding a detecting and triggering circuit. A conductive terminal integral with or attached to the first conductive shell extends out of the first cavity and is connectable to the other side of the protected circuit. The terminal and the first cavity define a transformer-receiver pocket, wherein the terminal acts as a single-turn primary for a current transformer.

First facilities support a partially surrounded detecting and triggering circuit in the second cavity. Further, second facilities are provided for connecting an output of a current transformer in the first cavity to the input of a detecting and triggering circuit in the second cavity. A second conductive shell defines a third cavity, which is also capable of partially surrounding a detecting and triggering circuit. Third facilities permit the attachment together of the conductive shells so that a detecting and triggering circuit in the second and third cavities is totally enclosed thereby, with the attached conductive shells being electrically continuous with each other and with the terminal and acting as a Faraday cage for the circuit. A fourth facility, locatable in the third cavity when the shells are attached, supports an enclosed detecting and triggering circuit and transmits output signals thereof to the exterior of the second shell. A fifth facility attaches the second shell to the interrupting module so that output signals of a detecting and triggering circuit are applied to the power cartridge and so that current from the other side of the protected circuit passes through the attached shells via the terminal to the other side of both the switch and the fusible element of the interrupting module.

In preferred embodiments, the detecting and triggering circuit includes a number of electrical components mounted on a plurality of separated circuit boards. Further, the attached conductive shells generally define a cylindrical volume enclosing the circuit boards and having a major axis. The second shell contains a passageway which communicates with the third cavity. The fourth facility may comprise an elongated insulative member, one end of which engages and supports at least one of the circuit boards, the other end of which is loosely held within the passageway as the shells are attached. The insulative member contains a bore which carries a conductor to which the output signals of the detecting and triggering circuit are applied. The insulative member may include an enlarged head at the one end thereof, the head containing at least one groove which engages the edge of at least one circuit board to support that circuit board when the conductive shells are attached. Preferably, the insulative member lies on the axis of the cylindrical volume, and the shells are attached by relatively rotating them to mesh interfitting threads thereon. Because the insulative member is loosely held in the passageway and is located on the axis of the cylindrical volume, such attachment of the shells does not rotate the insulative member and does not, accordingly, compromise either its circuit-board-supporting function or the integrity of the conductor contained within the bore thereof.

Also in preferred embodiments, the circuit boards are maintained within the enclosing cylindrical volume parallel to the major axis thereof. The circuit boards may be maintained in this orientation not only by the fourth facility, but also by the first facility, which may constitute a bracket and a number of stand-off posts between the circuit boards, the bracket being attachable between one circuit board and the first shell within the second cavity.

DETAILED DESCRIPTION

Figure 1:
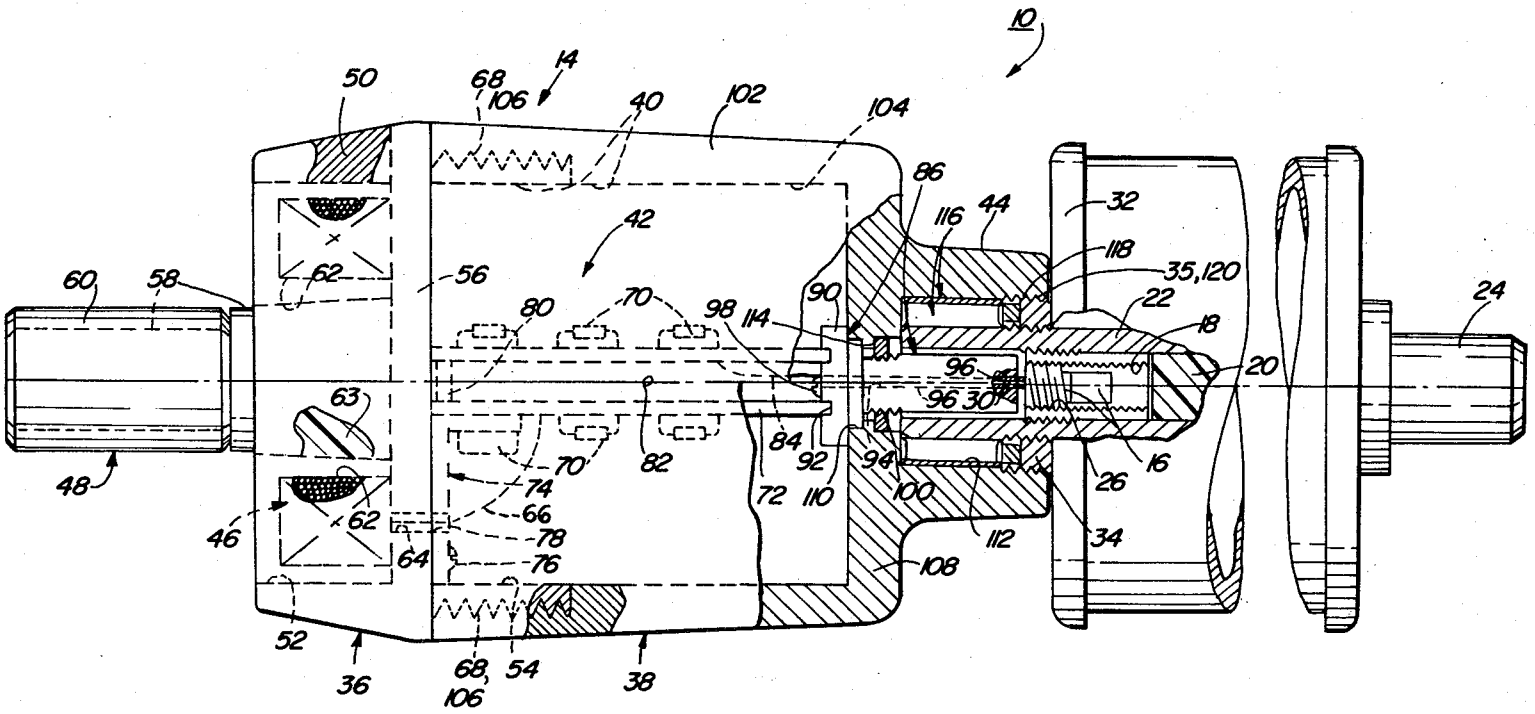
FIG. 1 is a partially sectioned, side elevation of a current-limiting fuse comprising an interrupting module and a separate electrical control module according to the principles of the present invention, the modules being associated for connection to a high-voltage circuit for protection thereof.

Referring first to FIG. 1, there is shown, a high-voltage current-limiting fuse 10, which comprises an interrupting module 12 and an electrical control module 14. The interrupting module 12 is more completely described in the above-referenced patent and patent applications and only certain portions thereof necessary for an understanding of the present invention are illustrated in FIG. 1 and described herein. The structure and function of the electrical control module 14 is the subject of the present invention.

In general, the interrupting module 12 includes a switch (not shown) and a fusible element (not shown) in electrical shunt therewith. The switch is normally closed to shunt current away from the fusible element. Opening of the switch is achieved by ignition of a power cartridge 16 contained in the interrupting module 12. Ignition of the power cartridge 16 pressurizes a chamber 18 and applies force to one end of a trailer or piston 20 carried by a movable contact (not shown) of the switch. This application of force to the trailer 20 opens the switch, commutating current from the switch to the fusible element for interruption thereof. The power cartridge 16 is ignited by the electrical control module 14 in response to a fault current or other overcurrent in a protected circuit (not shown) to which the current-limiting fuse 10 is connected.

The switch and the fusible element of the interrupting module 12 are connected in shunt between terminals 22 and 24 of the interrupting module 12. Thus, the terminals 22 and 24 carry the current that is flowing in the high-voltage circuit protected by the current-limiting fuse 10. Also, in preferred arrangements of the interrupting module 12, the power cartridge 16 is contained within a cavity 26 formed in the terminal 22. An input pin 30 to the power cartridge 16 extends away therefrom within the cavity 26. Application of an appropriate signal to the pin 30 ignites the power cartridge 16.

As can be seen in FIG. 1, one preferred construction for the interrupting module 12 includes an end plate 32 at the end of the module 12. The terminal 22 extends through and beyond the end plate 32. A collar 34 may hold the terminal 22 and the end plate 32 in their proper relative position, such as by threading or the like, and the exterior of the collar 34 may be threaded as at 35, for a purpose described below. The terminal 22 extends beyond the collar 34.

Still referring to FIG. 1, the electrical control module 14 may be seen to include a housing 35 comprising a first conductive shell 36 and a second conductive shell 38, which are attached together in a manner described below to define a volume or closed cavity 40 in which a detecting and triggering circuit or control circuit 42 is located. The second shell 38 includes a neck 44 which is internally threaded and which may be mated with the threads 35 on the collar 34 to attach the electrical control module 14 to the interrupting module 12, as described below. Output signals from the detecting and triggering circuit 42 are passed through the neck 44 in a manner described below to the pin 30 of the power cartridge 16 for appropriate ignition thereof. Furthermore, when the neck 44 is attached to the collar 34, current passing through the attached shells 36 and 38 is applied to the terminal 22 of the interrupting module 12 and, accordingly, flows either through the switch of that module 12 or through the fusible element of the module 12, depending on whether the switch is closed or open.

The first conductive shell 36 carries on the outside thereof, in a manner described below, a current transformer 46 or similar device. The current transformer detects the condition of current in the protected circuit to which the fuse 10 is connected and applies signals representative thereof to an input of the detecting and triggering circuit 42, again in a manner described below.

With the modules 12 and 14 connected together, as generally described above and as shown in FIG. 1, the right terminal 24 of the interrupting module 12 is connected to one point of the protected high-voltage circuit, while a terminal 48, integral with or attached to the first conductive shell 36, is connected to the other point of the protected circuit. Thus, the current of the protected high-voltage circuit passes from the terminal 48 through the first conductive shell 36, then through the second conductive shell 38, through the neck 44, and to the terminal 22 of the interrupting module 12. From the terminal 22, such current is conducted through either the switch (not shown) or the fusible element (not shown) of the interrupting module 12, and from there passes to the terminal 24 of the fuse 10, passing thereafter to the opposite side of the protected circuit. Further, the status of this current in the protected high-voltage circuit is monitored by the current transformer 46 which applies signals representative thereof to the detecting and triggering circuit 42 within the volume 40. When the detecting and triggering circuit 42 senses that the current in the circuit is a fault current or an over-current, output signals from the circuit 42 are applied to the pin 30 of the power cartridge 16 for ignition thereof. As already noted, ignition of the power cartridge 16 opens the switch (not shown) of the interrupting module 12, commutating current in the switch to the fusible element (not shown) of the interrupting module 12 for current-limiting or energy-limiting interrupting thereof.

Referring now to FIGS. 1 and 2–5, the first conductive shell 36 and various elements associated therewith are described in detail.

The first conductive shell 36 comprises an aluminum or similar conductive member 50 which defines a first cavity 52 and a second cavity 54. The first and second cavities 52 and 54 are separated by a wall 56 with the first cavity 52 ultimately being on the exterior of the module 14 and the second cavity 54 being on the interior of the module 14.

The terminal 48 of the first conductive shell 36 may comprise a post 58 formed integrally with or attached to the wall 56 and a surrounding sleeve 60. The post 58 is preferably centrally located relative to the first cavity 52 and extends out and away therefrom. The sleeve 60, which may be made from or plated with a highly conductive metal, such as silver or silver alloy, may be attached to the post 58 by a press fit or the like. To this end, the post 58 (or the sleeve 60 or both of them) may be knurled or roughened as shown at 61 in FIG. 3. With the two modules 12 and 14 attached, as shown in FIG. 1, the sleeve 60 is attached to one point of the protected high-voltage circuit (not shown) by appropriate mounting apparatus (not shown).

The first cavity 52 is configured to receive and contain the current transformer 46 or a similar device. The current transformer 46, which may have a generally torriodal shape, is intended to reside in the first cavity 52 with the terminal 48 extending through a central aperture 62 thereof. Since the terminal 48 is connectable to one point of the protected high-voltage circuit, the post 58 and the sleeve 60 may serve, in effect, as a single-turn primary winding for the current transformer 46. The current transformer 46 may be maintained in the first cavity 52 by encasing the transformer 46 with a material 63, such as an RTV polymer or a potting compound, which adheres to the transformer 46 and to the walls of the first cavity 52.

The wall 56 between the cavities 52 and 54 may contain an aperture 64. Output leads 66 of the current transformer 46 may pass through the aperture 64 into the second cavity 54 for connection to the detecting and triggering circuit 42. The conductive shell 50 may be threaded, as shown at 68, to the outside of the second cavity 54. This threading 68 permits the first conductive shell 36 to be attached to the second conductive shell 38, as described below.

Still referring to FIGS. 1 and 2–5, it may be seen that the second cavity 54 of the first conductive shell 36 is capable of partially surrounding the detecting and triggering circuit 42, which may be also supported therewithin. In preferred embodiments, the detecting and triggering circuit 42 comprises a plurality of electrical components 70 mounted to a plurality of circuit boards 72, two of which are depicted in the FIGURES. It should be understood that a greater or less number of circuit boards 72 may be present.

In preferred embodiments, mounted to the wall 56 within the second cavity 54 is a right angle bracket 74 which may be attached to the wall 56 by screws 76, or other convenient fasteners. The bracket 74 may also include a hole 78, alignable with the aperture 64 when the bracket 74 is attached to the wall 56, and through which the output leads 66 of the current transformer 46 may pass. As shown, the output leads 66 are soldered or otherwise connected at an appropriate point to one of the circuit boards 72 so that the detecting and triggering circuit 42 receives signals from the current transformer 46 indicative of the condition of the current in the protected circuit.

A portion of the bracket 74 extending away from the wall 56 may be attached, as convenient, to a surface of one of the circuit boards 72. This attachment maintains the circuit board to which the bracket 74 is connected stationary within the second cavity 54. The other circuit board (or boards) 72 is preferably attached to the circuit board 72 mounted to the bracket 74 by a plurality of stand-off posts 80, or similar facilities. In preferred embodiments, the bracket 74 and the stand-off posts 80 maintain the circuit boards in a spaced, parallel relationship at one end thereof so that the circuit boards 72 are maintained parallel to a major axis 82 of the volume 40 defined by the conductive shells 36 and 38. Also in preferred embodiments, the terminal 48 is coaxial with the axis 82.

If desired, the bracket 74 may overlie a substantial portion of the surface of the circuit board 72 to which it is attached. One or more of the components 70 may overlie the bracket 74 which, thus, acts as a heat sink therefor. Such components are electrically, but not thermally, insulated from the bracket using well-known techniques.

The detecting and triggering circuit 42 has an output lead 84 which is connected to and extends away from one of the circuit boards 72. As described above, the output lead 84 is ultimately electrically connected to the input pin 30 of the power cartridge 16. To this end, there is provided a supporting and signal transmitting plug 86, described below. As already described, the power cartridge 16 contains a single input pin 30 and the circuit 42 has a single output lead 84. When a signal is applied to the pin 30 by the output lead 84, the return path therefor includes the body of the power cartridge 16, the terminal 22, and the shells 36 and 38. Thus, there is no need to complicate the modules 12 and 14 by providing more than one pin 30 or output lead 84.

The plug 86 comprises an elongated insulative body 88 having an enlarged head 90 at one end thereof. The enlarged head 90 contains one or more grooves 92 which engage an edge of one or more of the circuit boards 72 as they are maintained in position by the bracket 74 and the stand-off posts 80. In preferred embodiments, the stand-off posts 80 are used only at the ends of the circuit boards 72 in the vicinity of the bracket 74; stand-off posts need not be used at the opposite ends of the circuit boards 72. Specifically, with the grooves 92 of the enlarged head 90 engaging the edges of the circuit boards 72 opposite the bracket 74, the circuit boards 72 are maintained apart in their spaced, parallel relationship at both ends thereof along the axis 82.

The enlarged head 90 and the insulative body 88 have a continuous bore 94 which contains a hollow or tubular conductor 96. The conductor 96 is attached at the outside of the head 90 to the output lead 84 of the detecting and triggering circuit 42, for example, by a screw 98 or other convenient fastener. The insulative body 88 may be threaded, as shown at 100, near the enlarged head 90 for a purpose to be described below.

Referring now to FIGS. 1, 2 and 6–8, the second conductive shell 38 is described in detail. The second conductive shell 38 comprises an aluminum or similar conductive member 102 which defines a third cavity 104. The conductive shell 102 is threaded within the cavity 104 as shown at 106 in a manner which permits threading attachment of the conductive shells 36 and 38. The third cavity 104 is sufficiently large to surround that portion of the detecting and triggering circuit 42 which is not surrounded by the second cavity 54. An end wall 108 of the third cavity 104 contains a hole 110 therethrough. The hole 110 is continuous with a bore 112 formed through the neck 44 of the second conductive shell 38. The neck 44 is formed integrally with or attached to the conductive member 102. Preferably, the neck 44, the hole 110, and bore 112 are coaxial with the axis 82.

In attaching together the conductive shells 36 and 38, the threads 68 and 100 are associated with each other by relatively rotating the shells 36 and 38. Prior to attachment together of the shells 36 and 38, the supporting and signal-transmitting plug 86 has its grooves 92 placed over the edges of the circuit board 72 and is generally located on the axis 82 within the cavity 104. Following this, the conductive member 102 is positioned adjacent to conductive member 50, and the two are attached by engagement of the threads 68 and 100. If desired, tool-engageable depressions 113 (FIGS. 3, 4, 6 and 8) may be formed in the members 50 and 102 to facilitate the tight attachment together thereof. After such attachment, a pin (not shown) may be simultaneously driven through the members 50 and 102 in the vicinity of the threads 68, 106 to prevent access to the interior of the volume 40.

Figure 2:
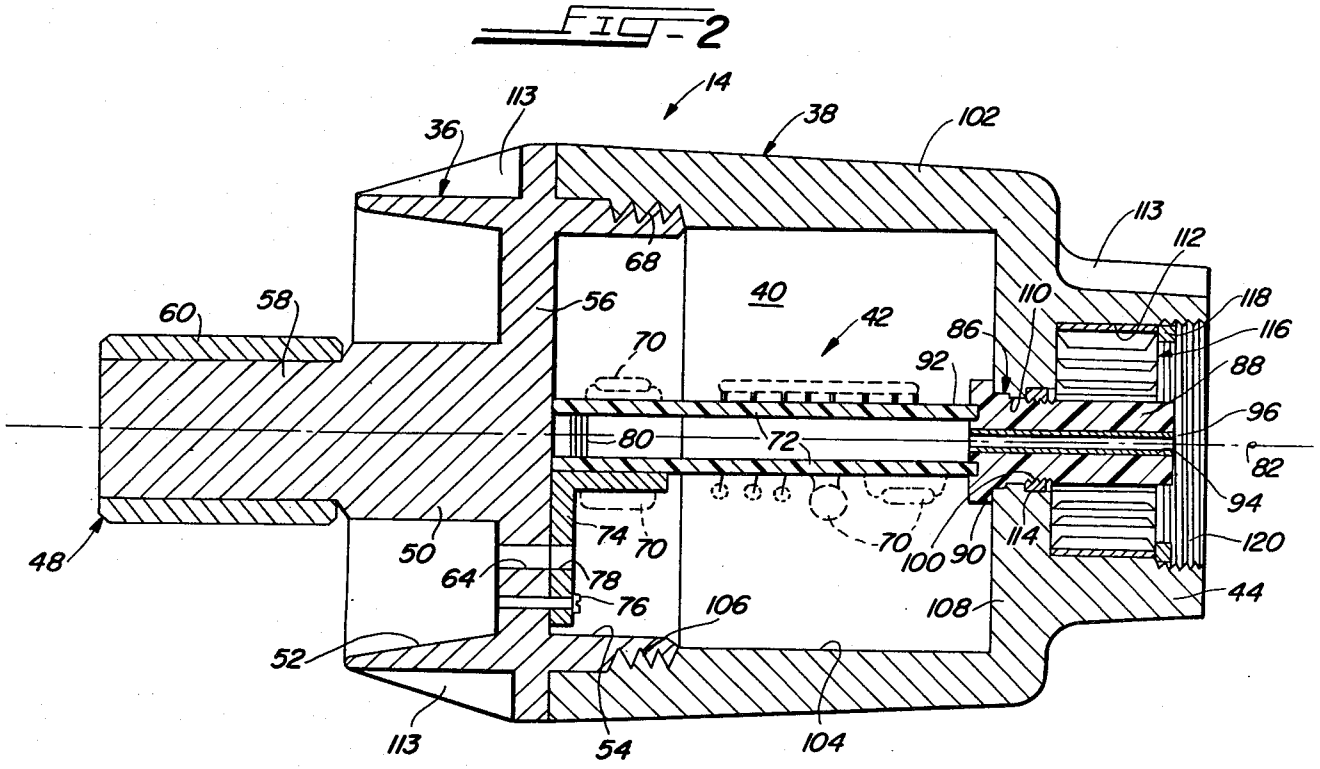
FIG. 2 is a sectioned, side elevation of the electrical control module generally depicted in FIG. 1 showing certain details thereof in accordance with the principles of the present invention.
Figure 3:
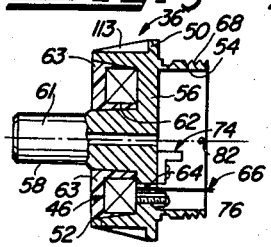
FIG. 3 is a sectioned, side elevation of a shell included in the module shown in FIG. 2.
Figure 4:
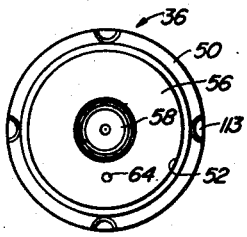
FIGS. 4 and 5 are end views of the shell depicted in FIG. 3.
Figure 5:
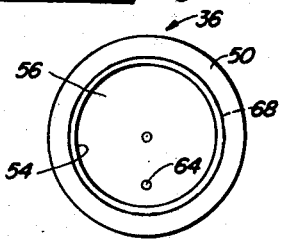
Figure 6:
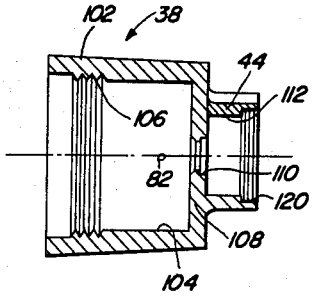
FIG. 6 is a sectioned, side elevation of another shell of the module shown in FIG. 2.
Figure 7:
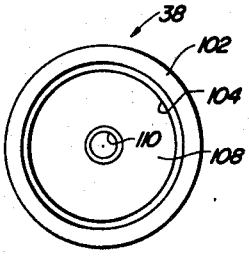
FIGS. 7 and 8 are end views of the shell shown in FIG. 6.
Figure 8:
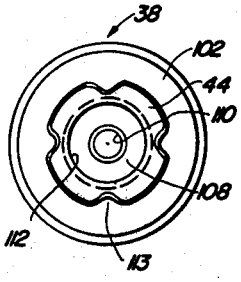
Figure 9:
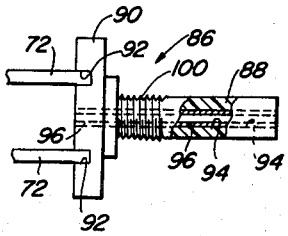
FIG. 9 is a side elevation in partial section of a portion of the module shown in FIGS. 1 and 2 illustrating in greater detail certain aspects thereof.

The size of the hole 110 and the bore 112 is sufficiently large so that the elongated insulative body 88 of the plug 86 loosely passes therethrough. Since the plug 86 is located on the axis 82 and loosely fits within the hole 110 and the bore 112, relative rotation of the conductive members 50 and 102 results in there being no rotative forces applied to the plug 86 during attachment of the shells 36 and 38. Accordingly, neither the supporting function of the plug 86 nor the integrity of the output lead 84 are compromised, as they could be by twisting. The elongated insulative body 88 of the plug 86 is sufficiently long so that after the conductive shells 36 and 38 are attached, the insulative body 88 protrudes into the bore 112 formed in the neck 44. After attachment of the conductive shells 36 and 38, a threaded collar 114 may be associated with the threaded portion 100 of the elongated insulative body 88. As shown in FIGS. 1 and 2, this collar 114 is located within the bore 112 of the neck 44 and locks undesirable movement of the supporting and signal transmitting plug 86 in place.

A portion of the interior of the bore 112 surrounding the protruding body 88 of the plug 86 may be lined with or contain a highly conductive, high-contact-force contact 116, such as a strip of material sold under the trade name Multi-Lam sold by Multilam Corporation of Los Altos, Calif. 94022, which is formed into a cylinder as shown. The contact 116 may be held in place within the bore 112 by a conductive washer 118, or the like, pressed into the bore 112. The washer 118 may be coated or plated with a highly conductive metal, such as silver or silver alloy. The interior of the bore 112, extending away from the washer 118, is threaded as shown at 120.

In attaching together the modules 12 and 14, the terminal 22 of the interrupting module 12 is first inserted into the bore 112 in the neck 44 of the second conductive shell 38. This insertion effects good electrical contact between the outside of the terminal 22 and wall of the bore 112 in the neck 44 due to the presence of the contact 116 within the bore 112. Following this insertion, the modules 12 and 14 are relatively rotated to engage the threads 120 within the bore 112 with the threads 35 on the collar 34. Both the engagement of the threads 120 with the threads 35 and the action of the contact 116 on the exterior of the terminal 22, as well as abutment of the free end of the collar 34 with the exposed surface of the washer 118, ensure good electrical continuity between the modules 12 and 14. As relative rotation of the modules 12 and 14 occurs, the input pin 30 of the power cartridge 16, which is coaxially related to the terminal 22 on the axis 82, enters and becomes electrically continuous with the hollow conductive member 102, which is coaxial with the axis 82. When the modules 12 and 14 have been fully connected, accordingly, the detecting and triggering circuit 42 is electrically connected to the power cartridge 16 and there is a continuous current path from the terminal 48 of the module 14 to the right-hand terminal 24 of the module 12.

The detecting and triggering circuit 42 may contain a number of sensitive electrical components. To this end, the attachment of the conductive shells 36 and 38 encases the detecting and triggering circuit 42, and, specifically, the components 70 on the circuit boards 72 thereof, within the volume 40 defined by the conductive shells 36 and 38. Thus, the components 70 are protected from the environment and from contaminants therein. Also, in effect, although the conductive shells 36 and 38 carry the current of the high-voltage circuit being protected, they also completely enclose the detecting and triggering circuit 42 and from a Faraday cage therefor. This Faraday cage shields the detecting and triggering circuit 42 from stray electrical fields and other electromagnetic radiation, thereby preventing adverse effects on the circuit components 70. Further, the close proximity of the detecting and triggering circuit 42 to the conductive shells 36 and 38, and the direct physical attachment of the bracket 74 to one of the circuit boards 72, provides a heat sink for critical components 70 of the detecting and triggering circuit 42, whereby these components 70 do not become overheated.

The coxial relationship of various elements of the module 14 to the axis 82 permits easy assembly of the module 14 and convenient attachment of the modules 12 and 14. The use of the plug 86 provides convenient support of the circuit boards 72—in conjunction with the bracket 74 and a mininal number of stand-off posts 80—combined with simple electrical connection of the circuit 42 to the power cartridge 16. The configuration of the first shell 36 conveniently and simply mounts both the current transformer 46 and the circuit 42, while providing a primary winding for the transformer 46 and permitting connection of its output to the circuit 42. The module 14 performs at least eight functions, namely, (a) mechanically supporting the fuse 10 at one end via the terminal 48; (b) providing a Faraday cage for the components 70; (c) providing a heat sink for the components 70; (d) providing a primary winding for the transformer 46; (e) conducting current from the protected circuit to the terminal 22 of the module 12; (f) supporting one end of the module 12; (g) providing a return path for signals applied to the pin 30 of the power cartridge 16; and (h) protecting the circuit 42 from the environment.

We claim:

1. An electrical control module connectable to an interrupting module having a normally closed, power-cartridge-operated switch in shunt with a fusible element, one side of both the switch and the fusible element being connectable to one side of a protected circuit, which control module comprises:

a conductive housing having a closed cavity which is capable of surrounding an electrical control circuit and acting as an environmental shield and Faraday cage thereof;

means for supporting the control circuit in the cavity and for transmitting output signals therefrom to the exterior of the housing;

first means for connecting the housing to the other side of the protected circuit;

second means for connecting the housing to the interrupting module so that the housing is electrically continuous with the other side of both the switch and the fusible element and so that the output signals of the control circuit are applied to the power cartridge by the supporting and transmitting means; and means on the exterior of the housing for sensing the condition of the current of the protected circuit and for providing signals representative thereof to an input of the control circuit.

2. A module as in claim 1, the control circuit including circuit-board-mounted components, wherein:

the supporting means comprises an elongated insulative member passing through the housing between the cavity and the exterior of the housing, and a transverse groove in one end of the insulative member for engaging the edge of the circuit board.

3. A module as in claim 1, wherein:

the supporting means comprises an elongated insulative member passing through the housing between the cavity and the exterior of the housing, and a conductor surrounded by and passing between the ends of the insulative member, the end of the conductor at one end of the insulative member being connectable to the output of the control circuit.

4. A module as in claim 3, the control circuit including circuit-board-mounted components, wherein:

the supporting means further comprises a transverse groove in the one end of the insulative member for engaging an edge of the circuit board.

5. A module as in claim 4, wherein:

the second means comprises a conductive neck on the housing which is joinable to the interrupting module so as to be electrically continuous with the other side of both the switch and the fusible element, the other end of the insulative member being surrounded by the neck so that the joining thereof to the interrupting module electrically connects the conductor to the power cartridge.

6. A module as in claim 5, wherein:

the supporting means further comprises a bracket mounted between the interior of the housing and the circuit board.

7. A module as in claim 6, wherein:

the edge of the circuit board engaged by the transverse groove is opposite an edge of the circuit board which is adjacent to the bracket.

8. A module as in claim 1, wherein:

the first means and the sensing means comprise an exterior cavity formed in the housing, and a conductive terminal electrically continuous with the housing and extending away therefrom out of the exterior cavity, the terminal being connectable to the other side of the protected circuit, the terminal and the exterior cavity together defining a transformer-receiving pocket, the terminal acting as a single-turn primary for a transformer received in the pocket.

9. An electrical control module connectable to an interrupting module to form a high-voltage current-limiting fuse of the type which is connectable in a circuit for protection thereof; the interrupting module being of the type in which current is commutated to a fusible element from a normally closed switch in electrical shunt therewith upon opening of the switch in response to the ignition of a power cartridge, one side of the switch and of the fusible element being connectable to one side of the protected circuit; there being includable with the control module a current transformer, an output of which is connectable to the input of a detecting and triggering circuit which responds to fault currents or other over-currents in the protected circuit sensed by the current transformer to generate a power-cartridge-ignition signal at an output thereof; wherein the electrical control module comprises:

a first conductive shell defining first and second opposed cavities, the second cavity being capable of partially surrounding a detecting and triggering circuit;

a conductive terminal integral with the first shell and extending out of the first cavity for connection to the other side of the protected circuit, the terminal and the first cavity defining a current-transformer-receiving pocket wherein the terminal acts as a single-turn primary of a transformer in the pocket;

first means for supporting a partially surrounded detecting and triggering circuit in the second cavity;

second means for connecting an output of a current transformer in the pocket to the input of a detecting and triggering circuit in the second cavity;

a second conductive shell defining a third cavity capable of partially surrounding a detecting and triggering circuit therein;

third means for attaching together the conductive shells so that a detecting and triggering circuit in the second and third cavities is totally enclosed thereby, the attached shells being electrically continuous with each other and with the terminal and acting as a Faraday cage for the circuit;

fourth means locatable in the third cavity when the shells are attached for supporting an enclosed detecting and triggering circuit and for transmitting output signals from such circuit to the exterior of the second shell; and fifth means for attaching the second shell to the interrupting module so that output signals of an enclosed detecting and triggering circuit are applied to the power cartridge and so that current from the other side of the protected circuit passes through the attached shells via the terminal to the other side of both the switch and the fusible element.

10. A module as in claim 9, wherein the detecting and triggering circuit includes a number of electrical components mounted on a circuit board, and wherein:

the exterior of the second shell contains a passageway therethrough communicating with the third cavity; and the fourth means comprises an elongated insulative member, one end of which is engageable with and can support a circuit board partially surrounded by the third cavity and the other end of which is located within the passageway, both when the shells are attached, the member having a bore which contains a conductor to which output signals of an enclosed detecting and triggering circuit are transmittable.

11. A module as in claim 10, wherein:

the second and third cavities of the attached shells define a generally cylindrical volume in which a circuit board may be enclosed, the volume having a major axis on which the terminal and the passageway are located;

the first and the fourth means are capable of maintaining a circuit board in the volume parallel to the major axis; and the fourth means further comprises at least one groove formed in the one end of the member for engaging the edge of a circuit board, the member lying on the axis.

12. A module as in claim 9, wherein:

the terminal is centrally located within the first cavity and the current transformer-receiving pocket is generally torroidal and complementary to the configuration of a current transformer, the configuration of the pocket permitting a current transformer to be maintained therein by a potting substance.

13. A module as in claim 12, wherein:

the second means comprises a hole through the first shell which communicates with the first and second cavities, the hole accommodating an output conductor of a current transformer in the pocket which may pass into the second cavity for attachment to a circuit board therein.

14. A module as in claim 9, wherein the detecting and triggering circuit includes a number of electrical components mounted on a plurality of circuit boards, and wherein:

the first means comprises stand-off posts for associating the circuit boards in a spaced, parallel stack, and a bracket attachable between one circuit board and the first shell within the second cavity.

15. A module as in claim 14, wherein:

the second and third cavities of the attached shells define a generally cylindrical volume enclosing the circuit boards and having a major axis, and the bracket maintains the associated circuit boards in the volume parallel to the axis.

16. A module as in claim 9, wherein:

the third means comprises external threads on one shell and internal threads on the other shell, the shells being attached by telescoping the one shell into the other shell and relatively rotating the shell to mesh the threads.

17. A module as in claim 16, wherein the detecting and triggering circuit includes a number of electrical components mounted on a plurality of separated circuit boards, and wherein:

the second and third cavities of the attached shell define a generally cylindrical volume capable of enclosing the circuit boards and having a major axis;

the first and second means are capable of maintaining the circuit boards within the volume parallel to the axis;

the exterior of the second shell contains a passageway therethrough communicating with the volume and lying on the axis; and the fourth means comprises an elongated insulative member loosely, partially locatable in the passageway, one end of which is engageable with and can support at least one circuit board in the volume, the other end of which passes through the passageway, so that relative rotation of the shells during their attachment does not rotate the member, the member having a bore which contains a conductor to which output signals of a detecting and triggering circuit are transmittable.

* * * * *